US008839878B2

(12) United States Patent
Tozer

(10) Patent No.: US 8,839,878 B2
(45) Date of Patent: Sep. 23, 2014

(54) DEVICE FOR COLLECTION OF DEBRIS

(75) Inventor: Warwick Brook Tozer, Brighton (AU)

(73) Assignee: Aero-Tech Pty Ltd., Victoria (AU)

( * ) Notice: Subject to any disclaimer, the term of this patent is extended or adjusted under 35 U.S.C. 154(b) by 501 days.

(21) Appl. No.: 13/148,453

(22) PCT Filed: Feb. 9, 2009

(86) PCT No.: PCT/AU2009/000149
§ 371 (c)(1),
(2), (4) Date: Nov. 4, 2011

(87) PCT Pub. No.: WO2010/088715
PCT Pub. Date: Aug. 12, 2010

(65) Prior Publication Data
US 2012/0047666 A1 Mar. 1, 2012

(51) Int. Cl.
*E01H 1/00* (2006.01)
*E01H 1/12* (2006.01)

(52) U.S. Cl.
CPC ..... *E01H 1/12* (2013.01)
USPC ..... 172/29; 172/199; 15/78

(58) Field of Classification Search
CPC ..... A46B 15/00; A46B 2200/3033; E01C 23/082; E01H 1/00; E01H 1/02; E01H 1/106; E01H 1/12
USPC ..... 15/78, 79.1, 104.8, 160, 221; 172/29, 172/199, 612, 189, 297, 445.1, 684.5; 171/63, 211
See application file for complete search history.

(56) References Cited

U.S. PATENT DOCUMENTS

| | | | |
|---|---|---|---|
| 768,358 | A | 8/1904 | Davis et al. |
| 1,061,709 | A | 5/1913 | Ward et al. |
| 1,350,512 | A | 8/1920 | Mowatt |
| 1,448,385 | A | 9/1921 | Bryant |
| 1,530,329 | A | 3/1924 | Roberts |
| 1,503,329 | A | 7/1924 | Mitchell |
| 1,775,316 | A | 9/1930 | McLeod et al. |

(Continued)

FOREIGN PATENT DOCUMENTS

| | | |
|---|---|---|
| AU | 13527/66 | 5/1968 |
| AU | 198811471 A1 | 8/1988 |

(Continued)

OTHER PUBLICATIONS

International Search Report of PCT/AU2009/000149, dated Apr. 1, 2009.

(Continued)

*Primary Examiner* — Robert Pezzuto
(74) *Attorney, Agent, or Firm* — Sughrue Mion, PLLC

(57) ABSTRACT

A device (10) for collecting debris from a ground surface (18). A flexible generally planar member (17) has openings (16) therethrough. When the device is laid on and forwardly moved over the ground surface (18) debris on the ground surface passes upwardly through the openings, over inclined pick-up portions (42) of the device and thence onto collection surfaces (25) of the device. The device has transversely extending openings (88) spaced in the lengthwise direction on inclined surfaces (68) of the pick-up portions (42) whereby under forward movement of the device (10) in use, debris is accumulated in the recesses (88). Debris accumulated in the recesses (88) tends to be retained therein during deceleration of the device (10).

26 Claims, 4 Drawing Sheets

(56) References Cited

U.S. PATENT DOCUMENTS

| | | | | |
|---|---|---|---|---|
| 1,786,194 | A | 12/1930 | Dickinson | |
| 1,997,248 | A | 4/1935 | Densberger | |
| 2,042,405 | A | 6/1935 | Knudson | |
| 2,287,133 | A | 12/1940 | Reiter | |
| 2,887,337 | A * | 5/1959 | Begue | 294/181 |
| 2,902,909 | A | 9/1959 | Reissinger | |
| 2,986,755 | A | 6/1961 | Sobie et al. | |
| 3,010,523 | A | 11/1961 | Gifford | |
| 3,263,755 | A | 8/1966 | Zink | |
| 3,823,962 | A | 7/1974 | Martin, Jr. | |
| 4,014,390 | A | 3/1977 | Teixeira | |
| 1,446,419 | A | 2/1983 | Glerum | |
| 4,379,569 | A | 4/1983 | Koch | |
| 4,505,338 | A | 3/1985 | Koval et al. | |
| 4,582,142 | A | 4/1986 | Bridge | |
| 4,651,450 | A | 3/1987 | York et al. | |
| 4,709,436 | A | 12/1987 | Berfield et al. | |
| 4,747,174 | A | 5/1988 | Hightower | |
| 4,836,295 | A | 6/1989 | Estes | |
| 5,018,587 | A | 5/1991 | Gandrud et al. | |
| 5,183,119 | A | 2/1993 | Wattenburg | |
| 5,284,211 | A * | 2/1994 | Tozer | 172/29 |
| 5,305,834 | A | 4/1994 | White | |
| 5,332,250 | A | 7/1994 | Thorwall et al. | |
| 5,588,174 | A | 12/1996 | Godfrey | |
| 5,918,684 | A | 7/1999 | Tozer | |
| 6,079,503 | A | 6/2000 | Tozer | |
| 6,139,043 | A | 10/2000 | Gries et al. | |
| 6,257,345 | B1 | 7/2001 | Tozer | |
| 6,454,018 | B2 | 9/2002 | Tozer | |
| 6,634,667 | B1 | 10/2003 | Tozer | |
| 7,124,463 | B2 | 10/2006 | Mathews et al. | |
| 7,249,429 | B2 | 7/2007 | Truan et al. | |
| 7,520,017 | B2 | 4/2009 | Wilmo et al. | |
| 8,250,696 | B2 * | 8/2012 | Tozer | 15/78 |
| 2001/0038921 | A1 | 11/2001 | Tozer | |

FOREIGN PATENT DOCUMENTS

| | | | |
|---|---|---|---|
| AU | 2000-055041 | A1 | 3/2002 |
| BE | 876521 | | 9/1979 |
| CH | 669 812 | A5 | 4/1989 |
| CN | 2668691 | | 1/2005 |
| DE | 26 33 215 | A1 | 1/1978 |
| DE | 8218672 | U1 | 10/1982 |
| DE | 295 08 830 | U1 | 11/1996 |
| EP | 0 265 015 | A2 | 4/1988 |
| EP | 0 301 153 | A1 | 2/1989 |
| GB | 151 197 | A | 9/1920 |
| GB | 640312 | | 7/1950 |
| JP | 6-15064 | | 1/1994 |
| WO | 90/13712 | A | 11/1990 |
| WO | 95/20310 | A1 | 8/1995 |
| WO | 96/09440 | A | 3/1996 |
| WO | 98/29609 | A1 | 7/1998 |
| WO | 2009/026624 | A1 | 3/2009 |

OTHER PUBLICATIONS

McPherson's Industrial Catalog, Sep. 3, 1975, by McPherson's Ltd., p. 287.

European Search Report dated Feb. 29, 2008 for European Application No. 05740269.5.

International Search Report dated Aug. 1, 1990 for International Application No. PCT/AU90/001730.

International Search Report dated Jul. 4, 2005 for International Application No. PCT/AU2005/000692.

International Search Report dated Jan. 2, 1996 for International Application No. PCT/AU95/00629.

European Search Report issued Jan. 15, 2013 for counterpart European Patent Application No. 08 783 000.

* cited by examiner

DEVICE FOR COLLECTION OF DEBRIS

CROSS REFERENCE TO RELATED APPLICATIONS

This application is a National Stage of International Application No. PCT/AU2009/000149 filed Feb. 9, 2009, the contents of all of which are incorporated herein by reference in their entirety.

FIELD OF THE INVENTION

This invention relates to a device for collection of debris.

BACKGROUND OF THE INVENTION

U.S. Pat. No. 5,284,211 and International Patent Application No. WO/1996/009440 disclose debris collection devices suitable, for example, for collecting small debris from a ground surface. These are each in the form of a mat-like structure having openings therethrough. The mat-like structure is laid on the ground surface and moved over the surface so the debris passes from the ground surface upwardly through the openings to rest on the upper surface of the structure. The device may then be moved to a suitable location at which the collected debris on the upper surface of the structure is removed, such as by up-ending the device. For example, the device of U.S. Pat. No. 5,284,211 has been found useful for clearing leaves from, and generally grooming, en tout cas tennis courts, and the arrangement of WO/1996/009440 useful for a variety of applications, including clearing debris such as bolts, screws, nuts washers and other foreign object debris, so called "FOD", from aircraft runways.

Arrangements such as shown in U.S. Pat. No. 5,284,211 and international application WO/1996/009440 have been found to be very satisfactory in use, offering a relatively inexpensive alternative to, for example, mechanical sweeping devices using rotary brushes. However, it has been noticed that, sometimes, there is a tendency for collected material on the mat structure to fall back through the openings in it, and be lost again. This tendency particularly occurs under abrupt deceleration of the device when it is being moved over the ground surface. Loss of collection efficiency due to this can be limited by ensuring that this deceleration is always relatively gentle, but it would be advantageous to be freer of this operational constraint.

International Patent Application No. PCT/AU2008/001252 describes a device for collecting debris from a ground surface, comprising a flexible generally planar member with an opening therethrough such that when the device is laid on and forwardly moved over a ground surface debris on the ground surface passes upwardly through the opening onto a collection surface of the device, the device having a transversely extending barrier positioned whereby, in use, debris passing upwardly through the opening passes upwardly over the barrier and then downwardly to the collection surface, the barrier at least partially obstructing movement of collected debris on the collection surface back into the opening under deceleration of the device as it is forwardly moved over the ground surface.

This has been found to greatly facilitate retention of debris during deceleration as mentioned, but even greater efficiency in that regard would be desirable.

SUMMARY OF THE INVENTION

According to one aspect of the present invention there is provided a device for collecting debris from a ground surface, comprising a flexible generally planar member with an opening therethrough such that when the device is laid on and forwardly moved over the ground surface debris on the ground surface passes upwardly through the opening onto a collection surface of the device, the device having an inclined surface extending upwardly and rearwardly from a transverse edge and which forms a rear edge of the opening and having a transversely extending recess such that at least part of the debris passing upwardly through the opening to the collection surface progresses over said inclined surface by movement to the recess, capture in the recess, and thence movement from the recess to the collection surface.

BRIEF DESCRIPTION OF THE DRAWINGS

The invention is further described by way of example only with reference to the accompanying drawings in which.

DETAILED DESCRIPTION OF THE PREFERRED EMBODIMENTS

Figure 1:
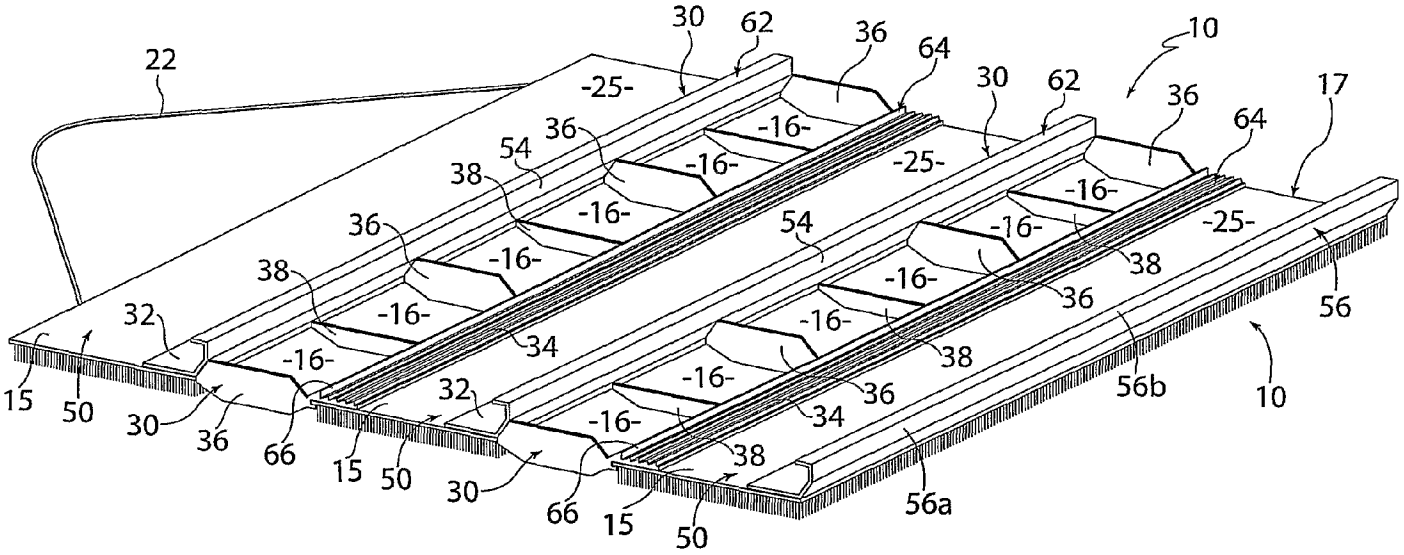
FIG. 1 is a perspective view of a debris collection device constructed in accordance with the teachings of International Patent Application No. PCT/AU2008/001252.
Figure 2:
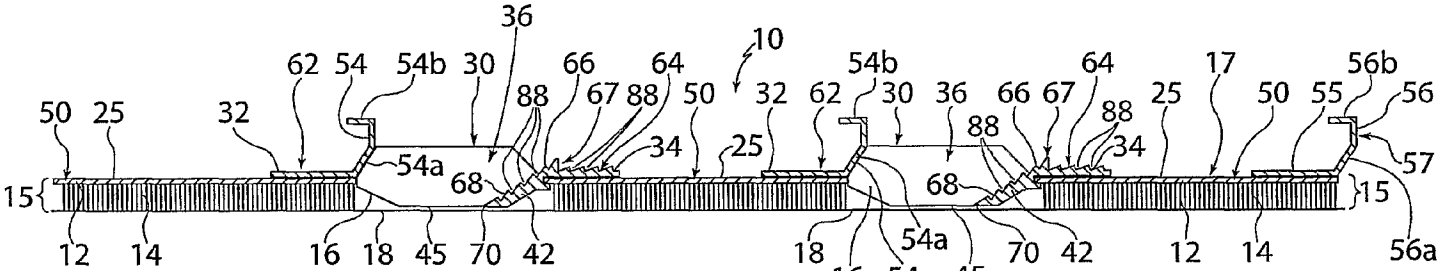
FIG. 2 is fragmentary vertical front to rear cross section of the device of FIG. 1.

The debris collection device 10 shown in FIGS. 1 to 6 is similar in general form to the debris collection device form described in International Patent Application No. PCT/AU2008/001252, the disclosure of which is hereby incorporated to form part of the disclosure of this application. Device 10 is formed as a flexible generally planar member 17 having sections 50 formed from conformable matting material 15 having, as shown in FIG. 2, a flexible laminar base portion 12 with depending bristles 14. There are three sections 50 arranged at lengthwise spaced locations, separated by two transverse frame structures 30. It has been found convenient to form the device from inverted artificial grass material of the kind used for the surfaces of tennis courts and the like, arranged with the bristles extending downwardly.

The device 10 has rectangular sidewardly elongate openings 16, there being a respective transversely extending row of the openings defined by each frame structure 30. When the device 10 is moved over a ground surface 18 (FIG. 2), such as by towing by use of a rope 22 at a forward end thereof, the bristles 14 agitate leaves, stones and the like on the ground surface by contact therewith and this debris tends to pass from the underside of the device 10 through the openings 16 to rest on upper collection surfaces 25 of sections 50. The debris so resting on the upper side of the device 10 can be then conveniently taken away on the device for disposal as desired.

In the illustrated embodiment, there are six openings 16 formed in each frame structure 30. Rows of the openings 16 in each of the frame structure 30 are respectively interposed, in the front-to-rear direction, between forward and intermediate ones of the sections 50, and the intermediate and rear ones of sections 50.

A leading frame structure 30 is secured at a transverse leading edge portion 32 thereof to a transverse trailing edge portion of a forward one of the sections 50, and at a trailing edge portion 34 to the a leading edge portion of an intermediately positioned one of the sections 50. A trailing frame structure 30 is secured at transverse leading and trailing edge portions 32, 34 respectively to a transverse trailing edge portion of the intermediately positioned section 50, and to a transverse leading edge portion of a trailing section 50.

The frame structures 30 may for example be secured to the sections 50 by use of bolts or other fixture elements 40 (FIG. 3), which extend through the edge portions 32, 34 of the frame structures 30 and the matting material 15. Alternatively, the sections might for example be stitched to the edge portions 32, 34.

Edge portions 32, 34 are formed as respective forwardly and rearwardly extending parts of leading and trailing transverse elements 62, 64 of the respective frame structure 30, and are generally coplanar. The edge portions 32, 34 overly the respective adjacent upper edge portions of sections 50 to which they are secured.

The openings 16 in each frame are defined between the leading and trailing transverse elements 62, 64 thereof and front to rear extending fin-like walls 36, 38 of each frame structure. Walls 36, 38 extend between and interconnect the transverse elements 62, 64. There are, in the illustrated device 10, four walls 36 for each frame structure 30, one outer one at each lateral side of the respective frame structure 30, and two inner ones positioned at locations one third of the distance inwards from a respective one of the outer walls 36. Each frame structure has three walls 38, each positioned midway between pairs of the walls 36. Walls 36, 38 are generally planar and vertically extending, and of relatively small thickness in the side to side direction of the device 10.

Each wall 36, 38 has a lower edge portion 45 which in the in-use position of the device 10, is parallel to and either rests on or is just above the ground surface 18. Walls 38 are of comparatively lesser height than walls 36, but are otherwise of similar form to walls 36.

Each forward transverse element 62 has an upstanding wall 54. Wall 54 has a generally upright part 54*a* extending upwardly from the rear edge of portion 32 and a part 54*b* that extends forwardly from the upper end of part 54*a* hereof. At the upper rear margin of the rearmost section 50, there is provided a side to side extending member 57, having a transversely extending flat portion 55 secured to the rear side to side margin of section 50 and having at the rear edge thereof an upstanding wall 56 similar to walls 54, having an upright part 56*a* extending upwardly from the rear edge of portion 32 and a part 56*b* that extends forwardly from the upper end of part 56*a*.

The walls 54, 56 present barriers serving to inhibit rearward movement of collected debris off the mat sections 50 during use of the device 10, so as to lessen loss of collected material from the device. That is, as collected debris accumulates on the surfaces 25, there is a tendency for this debris to move rearwardly, due to the continuing forward movements of the device 10, and the walls 54, 56 restrict movement of the collected debris back over the rear edges of the collection surfaces.

Trailing edges of the openings 16 of each frame structure 30 are defined by portions of the leading edge 70 of a transverse sloping pick-up portion 42 formed on the respective trailing transverse element 64. Each pick-up portion 42 has a front surface 68 that extends upwardly and rearwardly from the respective edge 70 at an acute angle to the ground surface 18. The pick-up portions join at the upper rear with forward parts of the portions 34 of the respective transverse element 64.

The front surface 68 of each pick-up portion 42 has an array of side to side extending recesses 88. These are spaced along the surface 68 in the front to rear direction of the device 10. Each recess has a forward side to side extending surface 78 which is angled downwardly from its forward edge and an adjoining rearward side to side extending surface 68*a* which is angled upwardly from the side to side extending junction with the respective forward surface 68*a*. Ones of the surfaces 68*a*, 78 of each recess 88 are formed by respective rear and forward surfaces on upstanding transverse walls 66 on the surfaces 68.

Further transverse side to side extending recesses 88 are formed on the upper surface of each trailing edge portion 34 of the respective frame structure 30. These are likewise arranged at respective locations spaced apart in the front-to-rear direction of the debris collection device. The further recesses 88 on trailing edge portions 34 extend from side to side of the trailing edge portions and are of generally the same form as those on pick up portions 42, having a forward side to side extending surface 78 which is angled downwardly from its forward edge and an adjoining rearward side to side extending surface 68*a* which is angled upwardly from the side to side extending junction with the respective forward surface 68*a*. Ones of the surfaces 68*a*, 78 of each further recess 88 are formed by respective rear and forward surfaces on further upstanding transverse walls 66 on the surfaces 68.

At walls 66, the respective surfaces 68*a* and 78 may meet at an apex 73 of the wall. The surfaces 78 may extend downwards from the respective apices 73 at an angle of about 90 degrees to the vertical, in the condition of the debris collection device for use. Alternatively, they may extend downwardly and forwardly or, as shown, downwardly and to some extent rearwardly. In the latter case, they may be best inclined at an acute angle to the vertical.

Figure 5:
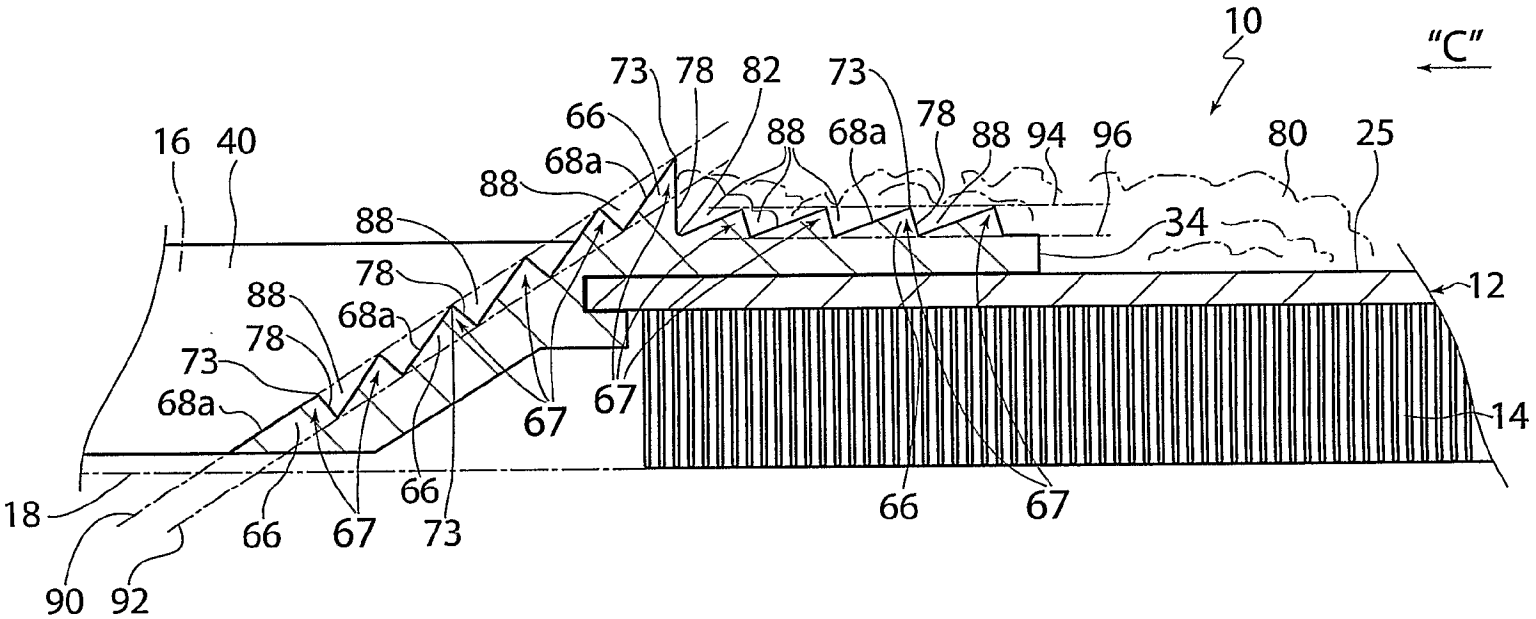
FIG. 5 is an enlarged front to rear upright cross section in the region "B" in FIG. 3.

As described in PCT/AU2008/001252, the uppermost walls 66 on the pick-up portion serve to inhibit forward movement of collected debris 80 from the intermediate and rear mat sections 50 from passing forwardly back into the openings 16 immediately in front thereof, during deceleration of the device 10 as it is used. In particular, under deceleration, during forward movement of device 10, resultant forward movement of the collected debris 80 along collection surfaces 25, in the direction "C" in FIG. 5, is at least in part obstructed by piling up of the debris 80 against the upstanding wall surfaces 78 of the uppermost walls 66. On the other hand, the sloping front surfaces 68*a* of the uppermost walls 66 facilitate flow of debris 80 picked up by the device to pass upwardly and rearwardly along the pick-up portions 42, upwardly of rearwardly to clear the apexes 73 of the uppermost walls 66 to fall and be collected on the collection surfaces 25 of the intermediate and rear mat sections 50. This movement of debris along surface 68 of pick-up portions 42 and over the adjacent uppermost wall 66 is illustrated by path "D" in FIG. 5. By this, the uppermost walls 66 form respective barriers 67 to impede forward movement of collected debris, while permitting rearward flow thereover to the collection surfaces.

In the device of this invention, each wall 66 forms a barrier 67 which assists in retention of collected debris during deceleration of the device 10, as described. This action is facilitated by the provision of the recesses 88 on the pick-up portions 42, and the provision of multiple walls 66. The walls 66 each form an additional barrier 67 formed to permit flow thereover rearwardly but to inhibit backflow. Additionally however, during normal use of device 10, at least part of the debris passing upwardly through opening 16 along inclined surface 68 progresses by at least momentary retention in recesses 88 at successively higher and more rearward locations. Accordingly, under deceleration, such retained materials instead of moving relatively forwardly off surface 68 is retained thereon in the recesses 88. In the arrangement described in PCT/AU2008/001252, for example, a small proportion of this debris may remain on the pick-up portion 42 and not reach the collection surface 25. If the operator decelerates, for example to stop and empty the collected debris, this debris can fall back to the road surface. This requires the operator to circle around and re-sweep this area of roadway. With the arrangement of FIGS. 1 to 5, the retention of debris in the recesses 88 during normal operation may avoid the need to re-sweep.

The provision of multiple recesses 88 on the trailing edge portion 34 has been found to also assist in retention of debris on the collection surface 25 during deceleration of the debris collection device. By action similar to that described in relation to recesses on pick-up portion 42, action, at least a portion of debris moving rearwardly to collection surface 25 from opening 16 passes rearwardly from recess 88 to recess 88 at the edge portion 34 at the forward part of the collection surface so that debris is retained therein under deceleration. Each further wall 66 on a trailing edge portion 34 constitutes a further barrier 67 formed to permit flow thereover rearwardly but inhibiting backflow.

It has been found that vibration aids collection of debris resting in the recesses on pick-up portion 42. As the device 10 travels over the ground surface such as an airport tarmac or roadway vibration is created by the rough surface of the pavement. This vibration creates an impetus assisting debris collection by activating any debris resting in the recesses and backwards to the collection surface 25.

Once the debris reaches the collection surface 25, the walls 66 at the collection surface combined with the natural vibration caused during sweeping carry the debris further rearwards to the main catchment area presented by the collection surface 25, thus also assisting in preventing the main body of collected debris moving forward upon deceleration.

Figure 4:
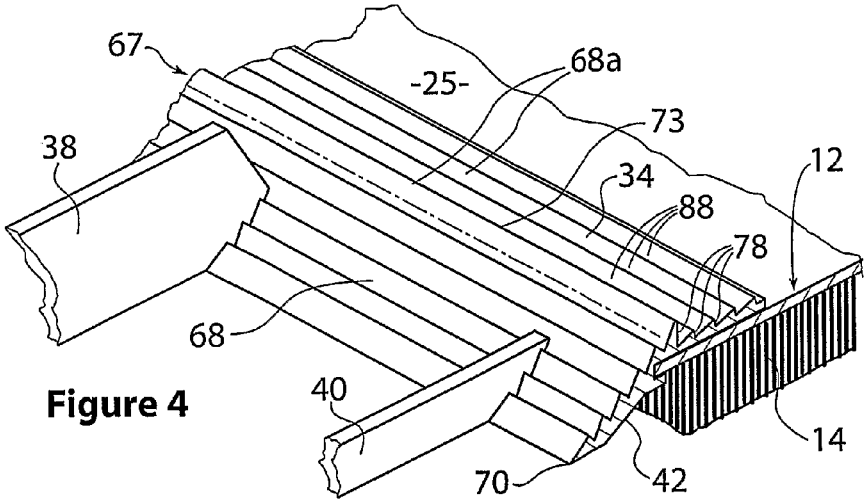
FIG. 4 is a perspective view of part of the device of FIG. 1, in the region "A" in FIG. 3.
Figure 6:
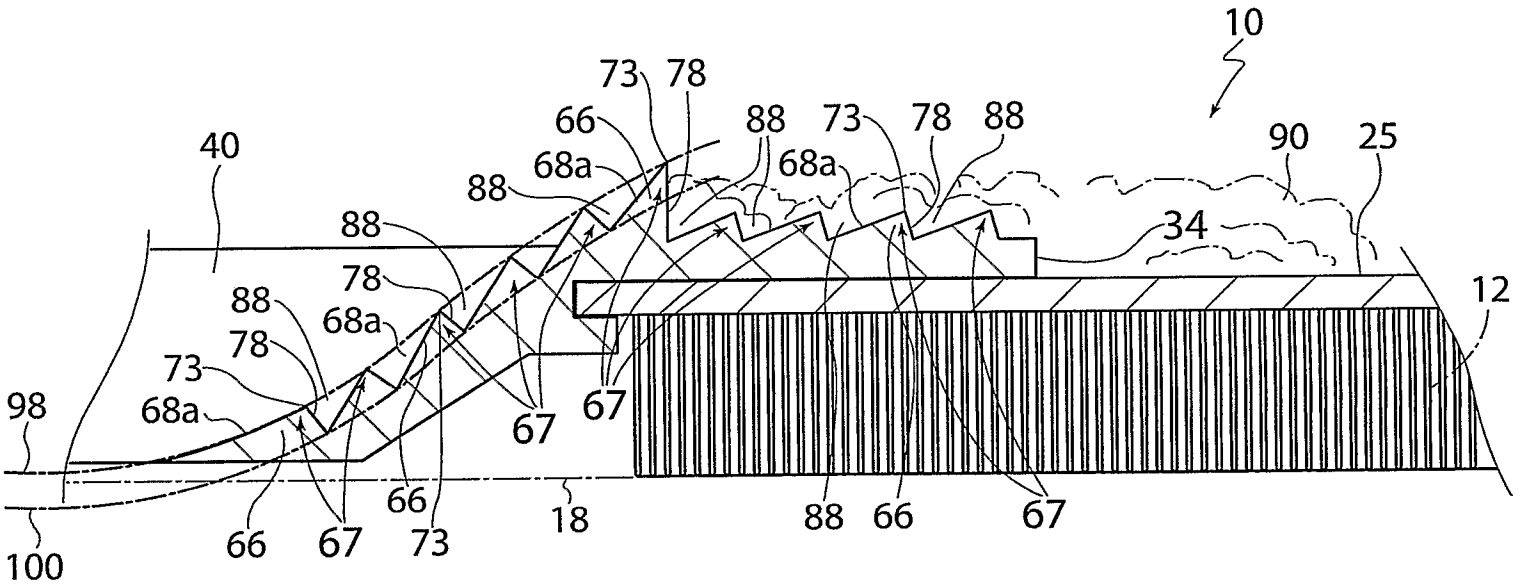
FIG. 6 is a cross-section like FIG. 5, but illustrating a further modification according to the present invention.

In FIGS. 4 and 5, the front and rear surfaces of the walls 66 are linear, when viewed in front to rear section. They may however be of different form. The forward walls 66 on each pick-up portion 66 at the forward edge of the pick-up portion 42 may have a concave front surface 68*a* and the last, uppermost, wall 66 has a concave front surface 68*a*. The surfaces may progressively and incrementally change in the front to rear direction from significantly concave, through generally linear to significantly convex. Thus, the front surface of the forward-most wall 66 may have pronounced convexivity, that immediately behind the forward-most wall lesser concavity, the following surface 68*a* being substantially linear, the following surface 68*a* exhibiting a degree of convexity, and the final surface 68*a* on the pick-up portion exhibiting significant convexivity. The forward surface 68*a* of the foremost wall 66 may, as shown in FIG. 6, meet the forward edge 70 of the pick-up portion at an apex, with that surface 68*a* of that wall 66 being at a small angle only to the horizontal, in the in-use condition of the debris collection device 10, that surface 68*a* then increasing in slope in the rearward direction away from the edge 70.

The array of walls 66 on the each pick-up portion 42 and the array of walls 66 on each trailing edge portion 34 may be linear in the sense that the root portions and/or apices of each wall are aligned in respective linear arrays. In the arrangement of FIG. 5, the arrays of the apices 13 and roots of the walls 66 on pick-up portion 42 are contained in respective linear planes 90, 92 and apices and roots of walls on trailing edge portion 34 are contained in respective linear planes 94, 96. In the embodiment of FIG. 6, however, while the walls 66 on the trailing edge portion 34 are similarly arranged, those on the pick up portion have their apices arranged in an array having generating lines 98, 100, respectively, which, when viewed form the side of the debris collection device are sinuous in form, the generating lines being concave at a forward part thereof and convex at a rear part thereof.

In the forgoing explanation, concave, concavity, convex and convexivity are taken as being reckoned from above the debris collection device 10, when in condition for use, unless the context requires otherwise.

While it is not essential, the walls 66 may be substantially contiguous in the sense that the rear surfaces of all or at least most of the walls 66 except the trailing wall 66 meet the lower edge the front surface of the following wall 66 at a respective side to side root line so that when viewed in front to rear cross-section, the walls present a substantially "saw tooth" form.

Where the array of walls 66 on the pick-up portion 42 is generally linear as shown in FIGS. 4 and 5 the array may extend at about 30 degrees to the horizontal in condition for use of the device 10. That is, the planes 90 and 92 may extend at such angle. Such a linear array has been found satisfactory in general use, although the non-linear array of FIG. 6 has been found to aid collection under some circumstances, particularly under slow speed operation of the device 10.

As a result of the provision of the barriers 67 on the upper surface 68 of the pick-up portion 42, the upper surface has a "saw-tooth" configuration when viewed in section.

The devices of FIGS. 1 to 6 have been found to be particularly satisfactory for cleaning debris from hard surfaces such as asphalt, concrete or the like, as well as from grass and similar surfaces. It has also been found satisfactory for use in collecting small items such as nuts, bolts or the like such as from aircraft runways. With rough asphalt in particular, the collecting action is very efficient, the bristles 14 acting to clean the ground surface, directing debris to the upper surface of the device.

In one form of the above described device, it was found satisfactory to provide openings 16 of dimensions of the order of 260 mm by 60 mm width in front rear length, with the depth of the pile formed by the bristles 14 being of the order of 1 cm. The sizes may however be varied as necessary to adapt the invention to particular uses. For example, the openings 16 may be of the order of 10 to 300 mm length, measured in the front to rear direction of the device of the invention. At towing speeds of up to 30 Kph, a length of about 70 mm may be satisfactory, with greater lengths being employed with faster towing speeds, for example 100 mm where speeds up to 100 Kph are employed. Similarly, the depth of the pile provided by the bristles 14 may be varied. Generally, the longer the bristles, the better is the wearability, but shorter bristles are generally more efficient, since it is easier to direct objects through a lesser distance from the ground surface to the upper surface of the device. Practically, for small objects such as washers or the like a pile thickness of about 9 mm may be satisfactory. For large objects, greater depth may be employed. A choice of overall thickness of matting material of 5 to 15 mm will provide satisfactory pick-up of a range of commonly encountered small objects.

The bristles 14 should generally be flexible, and some degree of resilience is also desirable.

In an exemplary construction, the matting material 15 was artificial grass material, the bristles 14 being formed of polypropylene fibres and about 10 mm in length. The resultant mat-like structure is crushable by impression of hand pressure on the bristles (i.e. upwardly crushable), but has sufficient resilient to cause reasonably quick restoration to the original condition when pressure is removed. This artificial grass material is relatively flexible, the base material being flexible.

The described artificial matting material presents an undersurface constituted by the bristles which is readily able to conform to local variations in ground surface as the device 10 is passed over the ground surface, in particular being able to conform to surface undulations as well as accommodating small obstacles, and providing an effective sweeping action to agitate debris and cause it to move through the openings 16. While it is preferred that the device include a flexible base with a conformable portion in the form of the described bristles, other constructions are possible. For example, a layer of foamed plastics material could be used. In general, the whole of the device 10 should be flexible, although, particularly if a very thick under layer constituted by bristles, foam or other material is employed, this could be secured to a relatively rigid upper backing. The leading edge of the device may be provided with a rigid element to facilitate maintenance of the device in a spread out condition during towing over a surface.

The configuration and height of the wall 66 may be chosen to suit that particular kind of debris to be collected. For general use, a height of between 5-25 mm may be useful.

In general, the height may be greater for larger types of material to be collected and smaller for smaller types of material. That is, smaller types of material may have lesser forward momentum when collected, so that forward movement under deceleration of the device may be more easily resisted. Also, the relatively greater momentum of heavier material when passing upwardly from openings 16 may enable them to be efficiently carried rearwardly over a higher barrier 67.

Figure 7:
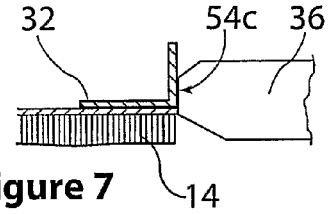
FIG. 7 is a fragmentary cross-section of the device of FIGS. 1 to 5, showing another modification.
Figure 3:
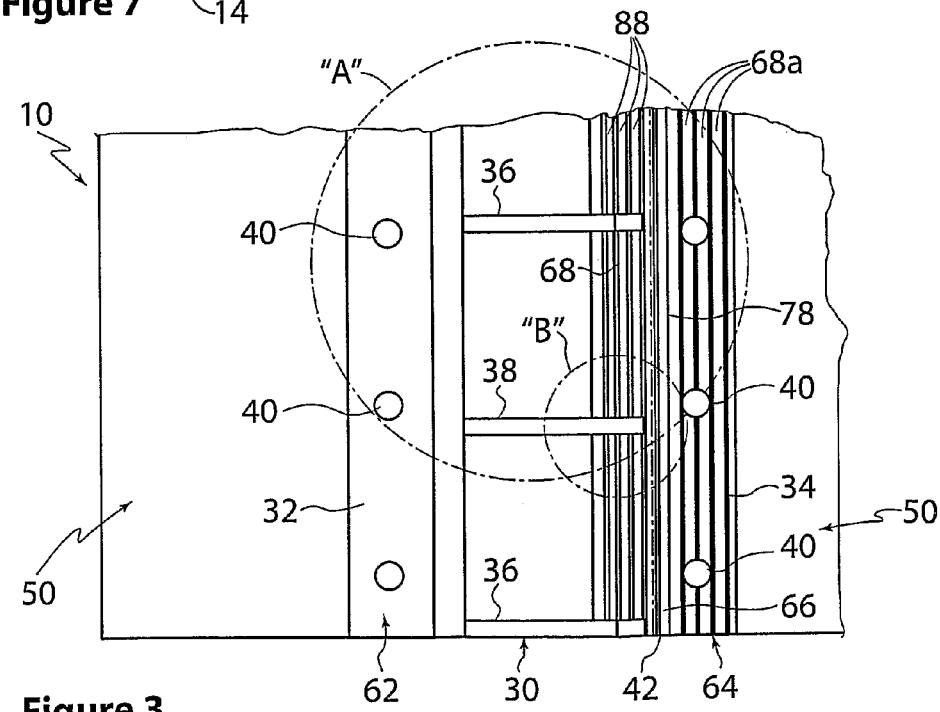
FIG. 3 is a fragmentary plan view of the device of FIG. 1.

The walls 54 may be alternatively formed as simple transverse upstanding elements 54*c* as shown in FIG. 7, and wall 56 may be similarly formed.

As shown in FIG. 5, the walls 66 forming barriers 67 at the uppermost ends of the pick-up portions 42 join to the respective edge portions 34 at respective radiused filet portions 82, so that the rear surfaces 78 of walls 66 merge smoothly with the upper surface of the respective portion 34. By this, root portions of the walls 66 are of greater width viewed in transverse section as in FIG. 5, and there is no sharp corner between these surfaces. This aids in strengthening the walls 66. Also, the arrangement assists by inhibiting catching of debris in the corners between surfaces 78 and surfaces of edge portion 34, when the device 10 is lifted to shake debris forwardly and out of the device 10. The uppermost walls 66 in the arrangement of FIG. 6 may be similarly configured. Each wall 66 of device 10 may be formed with a filet portion 82.

In general, the dimension of the openings 16 in the front to rear direction of the device may be about the same or slightly greater than the front to rear lengths of the sections 50. The device may be of any convenient dimensions. A length of the order of 1.5 meter and a width of the order of 2.4 meters may be satisfactory for general manual use.

The described construction has been advanced merely by way of example and many modifications and variations may be made without departing from the spirit and scope of the invention, which includes every novel feature and combination of features herein disclosed.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge.

The invention claimed is:

1. A device for collecting debris from a ground surface, comprising:

a flexible generally planar member with an opening therethrough such that when the device is laid on and forwardly moved over the ground surface, debris on the ground surface passes upwardly through the opening onto a collection surface of the device;

an inclined surface extending upwardly and rearwardly from a transverse edge and which forms a rear edge of the opening and having a transversely extending recess on said inclined surface such that at least part of the debris passing upwardly through the opening to the collection surface progresses over said inclined surface by movement to the recess, capture in the recess, and subsequently move from the recess to the collection surface, so that some of the debris remains captured in the recess.

2. A device as claimed in claim 1 wherein said transversely extending recess extends substantially from side to side of said inclined surface.

3. A device as claimed in claim 1 wherein said transversely extending recess is one of a plurality of transversely extending recesses on said inclined surface, spaced in a lengthwise direction of the device.

4. A device as claimed in claim 3 wherein substantially all of said inclined surface contains said transversely extending recesses.

5. A device as claimed in claim 3 wherein each said transversely extending recesses are formed between transverse upstanding walls on a pick-up portion of the device on which said inclined surface is formed.

6. A device as claimed in claim 5 wherein a rear part of each of said transversely extending recesses is formed by a first upstanding forward surface of a respective rearwardly disposed one of said upstanding walls and a forward part of each recess is formed by an upstanding rear surface of a respective forwardly disposed one of said upstanding walls.

7. A device as claimed in claim 6 wherein each said upstanding walls has a respective said first surface and a respective second surface.

8. A device as claimed in claim 7 wherein the first surfaces successively rearwardly of the device progress incrementally from lesser to greater inclination.

9. A device as claimed in claim 8 wherein the first surfaces successively rearwardly of the device progress incrementally from concavity to convexity.

10. A device as claimed in claim 9 wherein said first surface and second surface of each said wall at least substantially meet at an apex of that wall.

11. A device as claimed in claim 10 wherein the apices of said walls are arranged in a linear array.

12. A device as claimed in claim 7 wherein bases of said walls are arranged in a linear array.

13. A device as claimed in claim 10 wherein said recesses are of substantially the same cross-sectional form.

14. A device as claimed 10, wherein said apices of said walls are arranged on a sinuous array.

15. A device as claimed in claim 14 wherein bases of said walls are arranged on a sinuous array.

16. A device as claimed in claim 12 wherein said arrays are substantially parallel.

17. A device as claimed in claim 14 wherein said arrays are substantially parallel.

18. A device as claimed in claim 1 having a further transversely extending recess at a forward part of said collection surface arranged whereby in use of the device at least part of the debris moving rearwardly from said inclined surface to the collection surface progresses by movement to the further recess, capture in the recess, and thence movement from the further recess to the collection surface.

19. A device as claimed in claim 18, wherein said further recess is one of a plurality of further recesses spaced in the lengthwise direction of the device.

20. A device as claimed in claim 19 wherein each further recess is defined between further upstanding transverse walls of the device.

21. A device as claimed in claim 20 wherein the further walls extend substantially from side to side of the device.

22. A device as claimed in claim 18 wherein each recess and each further recess is in the range 5-25 mm deep.

23. A device as claimed in claim 1 wherein the planar member defines a section thereof, in use being behind the opening, a surface of which section is uppermost in the condition for use of the device and forms the collection surface.

24. A device as claimed in claim 23 wherein the section has an underside formed of conformable material so that, in use of the device, the underside may locally conform to undulations in the ground surface.

25. A device as claimed in claim 23 wherein the section is formed from a flexible layer having depending bristles.

26. A device as claimed in claim 5 wherein a rearmost said wall on said inclined surface forms a barrier positioned whereby, in use, debris passing upwardly through the opening passes upwardly over the barrier and then downwardly to the collection surface, the barrier at least partially obstructing movement of collected debris on the collection surface back into the opening under deceleration of the device as it is forwardly moved over the ground surface.

* * * * *